United States Patent [19]

Spitaler et al.

[11] Patent Number: 4,602,804

[45] Date of Patent: Jul. 29, 1986

[54] SAFETY SKI BINDING

[75] Inventors: Engelbert Spitaler, Wr. Neudorf; Hubert Wüerthner, Hainburg, both of Austria

[73] Assignee: TMC Corporation, Baar, Switzerland

[21] Appl. No.: 648,856

[22] Filed: Sep. 7, 1984

[30] Foreign Application Priority Data

Sep. 8, 1983 [AT] Austria ..... 3214/83

[51] Int. Cl.[4] ..... A63C 9/08

[52] U.S. Cl. ..... 280/632; 280/634

[58] Field of Search ..... 280/628, 631, 632, 634

[56] References Cited

U.S. PATENT DOCUMENTS

| | | | |
|---|---|---|---|
| 3,473,817 | 10/1969 | Adam | 280/632 |
| 3,762,735 | 10/1973 | Smolka | 280/612 |
| 3,933,363 | 1/1976 | Schweizer et al. | 280/632 |
| 4,533,155 | 8/1985 | Krob et al. | 280/628 |

FOREIGN PATENT DOCUMENTS

| | | |
|---|---|---|
| 2904798 | 8/1979 | Fed. Rep. of Germany . |
| 1485708 | 6/1967 | France . |

*Primary Examiner*—David M. Mitchell
*Assistant Examiner*—Richard M. Camby
*Attorney, Agent, or Firm*—Flynn, Thiel, Boutell & Tanis

[57] ABSTRACT

A safety ski binding includes a sole holder which is pivotally supported on a base member for movement upwardly about a transversely extending axle relative to the base member. The sole holder in the position of use is held thereat by a locking spring which acts onto a locking mechanism also supported on the base member. A hand lever is pivotally secured to the base member for movement about a second transversely extending axle, and through compression of the locking spring overcomes the spring loading of the locking mechanism. Thus, the sole holder can be swung upwardly force-free. The locking mechanism includes a first locking rocker arm which is pivotally supported for movement about the second axle and engages the sole holder and a second locking spring. The second locking rocker arm is also supported on the base member. The hand lever engages the first locking rocker arm so that upon a manual manipulation thereof, the locking spring will be compressed until the sole holder can be freely swung upwardly.

11 Claims, 5 Drawing Figures

SAFETY SKI BINDING

FIELD OF THE INVENTION

This invention relates to a safety ski binding comprising a sole holder which can be pivoted upwardly about a transversely extending axle relative to a base member, which sole holder in the position of use is held thereat by a locking spring which acts onto a locking mechanism also supported on said base member, a hand lever being provided, which through the compression of the locking spring overcomes the spring loading of the locking mechanism, so that the sole holder can be pivoted upwardly force-free.

BACKGROUND OF THE INVENTION

Such safety ski bindings are known in various designs. In one type of these bindings, the locking mechanism consists of a locking rocker arm which is pivotally supported to the front area of the base member for movement about a pivot axis which extends parallel with respect to transversely extending axle of the sole holder the front area of the locking rocker arm having a locking nose thereon, which in turn cooperates with a counternotch provided at the rear area of the sole holder such that in the downhill skiing position, namely, in the closed position of the binding, the locking nose and the counternotch engage one another; in the release position, be it through an automatic or voluntary release, however, the locking nose and counternotch become disengaged from one another. The locking rocker arm is on its side remote from the locking nose loaded by the locking spring.

In a different known binding of this type, the locking rocker arm is hinged to the upwardly swingable sole holder and is also loaded by a locking spring, whereas the counternotch is provided on the base member.

In another known binding according to French Pat. No. 1 485 708 (see in particular FIGS. 2, 5 and 6), the hand lever is hinged to the spring-loaded locking rocker arm, and the hand lever in the skiing position grips under a ramp on the sole holder by means of its cam-shaped end area and during a voluntary release is supported on a ski-fixed structural part.

All of these structures have the distinct disadvantage that a voluntary stepping out of the binding by means of the hand lever is possible only by overcoming the entire force of the locking spring. This operation can be carried but still relatively simply on a flat terrain, for example during a removal of the skis after skiing; however, on a steep hill, in particular in deep snow or after a fall when the binding, for whichever reasons, did not open, it can be carried out only with extreme difficulties. An injured skier can under these circumstances possibly not at all come free from his skis without the assistance of another person.

It is an object of the invention to substantially reduce the amount of force needed for effecting a voluntary release in a ski binding of the above-mentioned type, without influencing in an unfavorable manner the properly adjusted holding force for the automatic release function.

The set purpose is inventively attained by providing a locking mechanism which loads the sole holder, which has a first locking rocker arm supported on a base member and a second locking rocker arm interposed between the first rocker arm and a locking spring, which second locking rocker arm is also supported on the base member, a hand lever engaging the first locking rocker arm and being supported preferably on the same axle as the first locking rocker arm.

Due to the fact, that the hand lever engages the first locking rocker arm and the locking spring engages the second locking rocker arm, a moment arm is achieved, in which the force which is needed for holding down the sole holder is applied by the locking spring in the desired strength, whereas for the voluntary stepping out of the binding and for overcoming the locking spring, a force which is reduced corresponding with the lever relationships must only be applied onto the hand lever.

In a ski binding according to German OS No. 29 04 798, it is already known to permit the spring force which acts onto a locking rocker arm pivotally suspended from above and through the interpositioning of a cam to act onto the sole holder. The hand lever which effects a voluntary release engages the locking rocker arm, namely, the structural part, loaded by the locking spring. This means, however, that during a voluntary release, the force of the locking spring must be overcome practically totally; only the points of engagement of hand lever and locking spring permit a slight reduction of force.

Compared with this, the invention achieves a particularly favorable force ratio, because the hand lever engages a structural part which is not directly loaded by the locking spring. Thus it is possible to achieve a favorable force ratio or moment arm relationship through the points of engagement and support points of the individual structural parts. Furthermore, in the inventive solution a release function is achieved through a force applied by the hand lever, which feature in the known environment, due to the given construction, could only be realized with great difficulties. A further advantage over the known solution lies also in the provision of two locking rocker arms being able to cooperate with one another without the interpositioning of additional structural parts, which solution in the known design can also not be achieved due to the structural conditions and/or limitations.

Since furthermore in ski bindings the use of each additional structural part increases the susceptibility for breakdown and the weight of the binding, it is of an advantage if additional structural parts, even if to a small degree, can be reduced.

A preferable embodiment of the invention lies in the hand lever being of a bifurcated construction at its region adjacent the first locking rocker arm and having inwardly protruding extensions received in recesses of the first locking rocker arm. The point of engagement of the hand lever on the locking rocker arm can be adjusted through this development corresponding with the respective relationships.

Another preferable embodiment of the invention lies in the first locking rocker arm having an extension on its side facing the second locking rocker arm, which extension lies in a locking recess of the second locking rocker arm. Through this development, a rolling sliding movement is achieved during the release operation without requiring an additional structural part in the form of a roller.

Another preferable embodiment of the invention lies in the first locking rocker arm being connected to the second locking rocker arm through at least one link member pivotally connected by means of bolts to the first and second locking rocker arm. This development improves the precision of the connection of the two locking rocker arms; however, the rolling or pivot friction which now occurs at two points, is also present in this embodiment.

BRIEF DESCRIPTION OF THE DRAWINGS

Further characteristics, advantages and details of the invention will now be described in greater detail with reference to the drawings, which illustrate two exemplary embodiments.

In the drawings.

DETAILED DESCRIPTION

Figure 1:
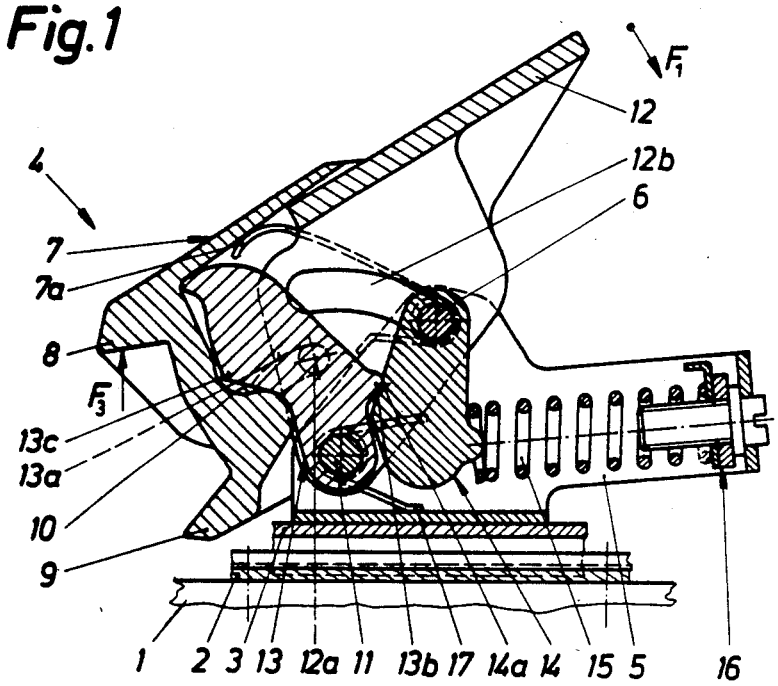
FIG. 1 is a central longitudinal cross-sectional view of the binding in the closed position and taken along the line I—I of FIG. 2.

As one can take from FIGS. 1 to 4, a guide rail 2 is secured in a conventional manner to the upper side of a ski 1 by conventional means, as by screws schematically indicated. A base plate 3 of a ski binding, which in this embodiment is a heel holder 4, is movably supported on the guide rail 2 for movement in the longitudinal direction of the ski 1. The base plate 3 is fixable in desired positions along the length of the guide rail 2.

A base member 5 is secured to the base plate 3 of the heel holder 4 in a conventional manner. The base member could, as is also known, be pivotally supported on the base member 5 about a not illustrated vertical axis on the base member in a plane which lies parallel with respect to the upper side of the base plate. Additional measures could thereby be taken to enable the heel holder to undergo a controlled diagonal release; this measure by itself being known and is not the subject matter of the present invention.

The base member 5 has a first transversely extending axle 6 thereon, and which extends through an opening in an upper region thereon. The sole holder, which in its entirety is identified by the reference numeral 7, is pivotally supported on the transversely extending axle 6. The sole holder 7 itself has on a frontwardly facing side a sole down-holding means 8 thereon and a stepping spur 9 and, on the back side thereof, a cam surface 10 defining a counternotch. Furthermore, the base member 5 has a second transversely extending axle 11 extending through a further opening therein. The axle 11 extends parallel to the axle 6. A hand lever 12, which will be described yet in greater detail, is pivotally supported on the axle 11. Furthermore, a first locking rocker arm 13, which forms the one part of the locking mechanism, is pivotally connected to the second transversely extending axle 11. A second locking rocker arm 14 is pivotally connected to the first transversely extending axle 6, and is continuously urged in a clockwise direction by a locking spring 15 which is interposed between the arm 14, at one end thereof, and an adjusting device 16, at the other end thereof. The adjusting device 16 is adapted to adjust the initial tension of the spring 15. Such adjusting devices are known per se so that a further discussion of their design and operation is believed unnecessary.

Figure 2:
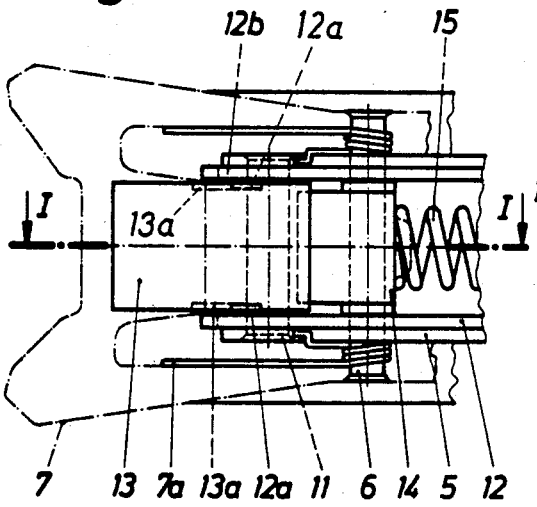
FIG. 2 is a partial top view of FIG. 1.
Figure 3:
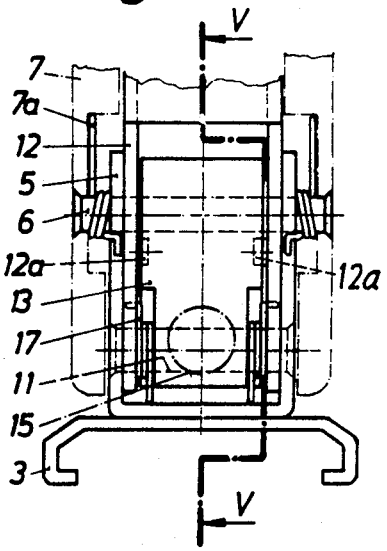
FIG. 3 is a front view of FIG. 1.

The hand lever 12 has, as one can observe in FIGS. 2 and 3, two inwardly projecting extensions **12*a* which are each received in a corresponding recess 13*a* provided on opposide lateral sidewalls of the first locking rocker arm 13. Furthermore, the hand lever 12 has on each of its two sidewalls an arcuate slot 12*b*, the centerpoint of the radius of the arc being coincident with the centerline of the second axle 11. In this manner, it is assured that the hand lever 12, during a pivoting movement thereof in one of the directions $F_1$ or $F_2$ about the axis of the second axle 11**, can be operated unhindered. The operation will be discussed in greater detail below.

The first locking rocker arm 13 has on its rear side, that is, the side which faces the second locking rocker arm 14, an extension **13*b*. The extension 13*b* extends into a locking recess 14*a* provided in the frontwardly facing side of the second locking rocker arm 14**.

Only in order to be complete, it is remarked that the front region (left end in FIG. 1) of the hand lever 12 is bifurcated and straddles the first locking rocker arm 13. The two extensions **12*a* are secured to the individual frontwardly extending legs of the hand lever 12. Furthermore, one can observe from FIG. 2 that the recesses 13*a* of the first locking rocker arm 13** can also be constructed or identified as steps.

The front region of the first locking rocker arm 13 facing the cam surface 10 has a locking nose **13*c* thereon and functions as a detent which is receivable in the counternotch on the sole holder 7 and, in combination, defines a locking mechanism. The sole holder 7 is continually urged by a torsion spring 7*a* into the opening direction, that is, clockwise about the axis of the axle 11. This movement is, however, blocked by the presence of the nose 13*c*** in counternotch.

If a force acts now onto the heel holder 4 in the vertical plane, as this is indicated by the arrow $F_3$, the sole holder 7 attempts to pivot clockwise about the axis of the first axle 6. The cam surface 10 is urged upwardly against the locking nose **13*c* on the first locking rocker arm 13, which in turn through the extension 13*b* urges the second locking rocker arm 14 and same in turn, also pivoting counterclockwise about the first axle 6, compresses the locking spring 15. It will be recognized by the man skilled in the art without any further illustration, that when the force $F_3$ ceases to act prior to the cam surface 10 becoming free of the locking nose 13*c*, the locking spring 15 will urge the second locking rocker arm 14 clockwise and transfer its force onto the first locking rocker arm 13 and same in turn swings the sole holder 7 again into the closed skiing position illustrated in FIG. 1**.

Figure 4:
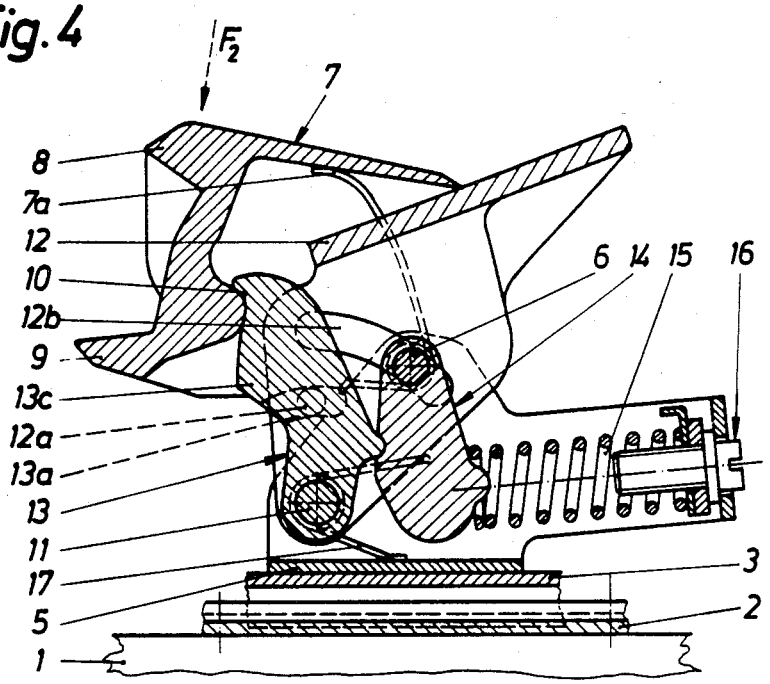
FIG. 4 is a central longitudinal cross-sectional view of the binding in the open position.

However, if the force $F_3$ is so great that the cam surface 10 becomes free of the locking nose **13*c*, then the position illustrated in FIG. 4 is reached and the not illustrated ski shoe becomes free of the binding, namely, it is released therefrom. The sole holder 7 remains, however, under the influence of the locking spring 15 and of the torsion spring 7*a*** when in the open position to make the binding suitable for stepping thereinto.

If the skier wants to exit voluntarily from the binding, then the hand lever 12 must be pivoted downwardly in the direction of the arrow $F_1$. This pivotal movement will cause the hand lever 12 to pull, through its two extensions **12*a*, the first locking rocker arm 13 therewith, so that the force transfer from same to the second locking rocker arm 14 and against the force of the locking spring 15 occurs in a similar manner, and as has been described above in connection with an automatic release operation. The important difference consists, however, in the necessary force input. In the case of an automatic release operation, the entire force of the locking spring 15 is used because the points of attack which are decisive for the release operation are effective only through a relatively small moment arm. Compared with this, during a voluntary release such moment arm becomes effective, which results from the hinge points and engagement points of the two locking rocker arms 13, 14 of the hand lever 12 and of the locking spring 15. It can therefore also be easily recognized that for this reason the extension 13*b* is to be constructed as low as possible on the first locking rocker arm 13. However, against this desire acts the other condition that this locking rocker arm 13 must carry out a sufficient pivoting movement, in order to be able to release the sole holder 7**.

Only to be complete it is remarked that the two arcuate slots **12*b* on the hand lever 12, referred to the first axle 6, determine simultaneously the two end positions of the hand lever 12. The two arcuate slots 12*b* of the hand lever 12 are thereby designed such that they can swing unhindered in the area of the first axle 6, both in the opening direction of the heel holder 4 according to the arrow $F_1$ and also in the closing direction of the heel holder 4 according to the arrow $F_2$ which is indicated with dashed lines. It is furthermore to be understood that the hand lever 12 is held in the position illustrated in FIG. 1 by means of a weak torsion spring 17**.

Figure 5:
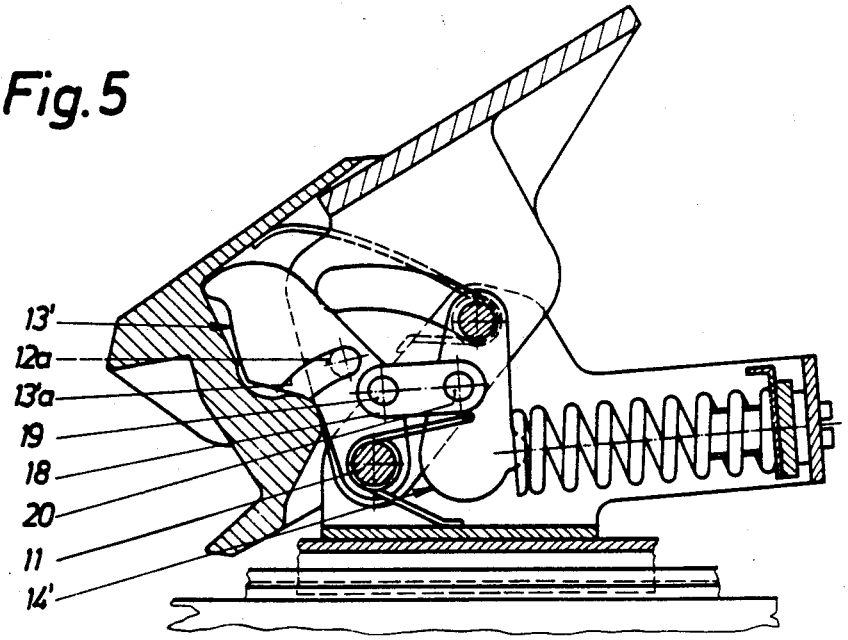
FIG. 5 illustrates in a cross section taken along the line of V—V of FIG. 3, a further exemplary embodiment, similar to FIG. 1, however, using linkage members.

The second exemplary embodiment according to FIG. 5 differs from the first exemplary embodiment only in the first locking rocker arm 13' being connected to the second locking rocker arm 14' through a pair of link members 18. The link members 18 are hinged to the rocker arms 13' and 14' by means of bolts 19, 20. The remainder of the structure and the operation of the heel holder 4' according to FIG. 5 corresponds to the structure and operation described above and in reference to the first embodiment.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A safety ski binding, comprising; a sole holder pivotally supported on a base member for upward movement from a downhill skiing position to a release position about a transversely extending first axle provided on said base member, said sole holder being releasably held in said downhill skiing position by a locking spring having a first end which is supported on said base member and having a second end which acts onto a locking mechanism which is also supported on said base member, and a hand lever supported for pivotal movement about a transversely extending second axle on said base member; wherein said locking mechanism includes a first locking rocker arm which is supported for pivotal movement about said second axle and engages said sole holder, and a second locking rocker arm interposed between said first locking rocker arm and said second end of said locking spring, said second locking rocker arm being movably supported on said base member and said hand lever operatively engaging said first locking rocker arm so that manual pivoting of said hand lever causes said first and second locking rocker arms to be moved against the force of and to compress said locking spring until said sole holder can be freely swung upwardly; wherein said hand lever is bifurcated at a region thereof adjacent said first locking rocker arm and has inwardly projecting extensions which are received in recesses provided in said first locking rocker arm to thereby effect said operative engagement of said hand lever and said first locking rocker arm; wherein said hand lever is pivotally supported on said second axle; and wherein said recesses in said first locking rocker arm are arcuate, the centerpoints of said arcuate recesses lying on the centerline of said second axle.

2. The binding according to claim 1, wherein said first locking rocker arm has on a side thereof which faces said second locking rocker arm an extension which is received in a locking recess provided in said second locking rocker arm.

3. The binding according to claim 1, wherein said first locking rocker arm is coupled to said second locking rocker arm by a link member which is pivotally connected to each of said first and second locking rocker arms.

4. A safety ski binding, comprising a base member, a sole holder which can pivot upwardly about a transverse first axis relative to said base member from a downhill skiing position to release position and which is releasably held in said downhill skiing position by a locking spring having a first end supported on said base member and a second end which acts onto a locking mechanism, said locking mechanism including a control surface on said sole holder, a first locking lever which is pivotally supported on said base member and engages said control surface and a second locking lever which is also pivotally supported on said base member and is positioned between said first locking lever and said second end of said locking spring, and including a hand lever which operatively engages and is supported for pivotal movement about the pivot axis of one of said locking levers, manual movement of said hand lever pivoting said first and second locking levers against the force of and compressing said locking spring so that the sole holder can be swung upwardly free of resistance from said locking mechanism, said hand lever being forked in a region thereof adjacent said one of said locking levers and having at least one inwardly projecting extension which can operatively engage said one of said locking levers, wherein said one of said locking levers is said first locking lever and said hand lever has two of said inwardly projecting extensions which can each engage a respective one of two shoulders provided on opposite sides of said first locking lever.

5. The binding according to claim 4, wherein said shoulders on said first locking lever are each provided at an end of a respective one of two arcuate recesses provided in said first locking lever, and wherein the centerpoints of said arcuate recesses lie on the pivot axis of said first locking lever.

6. The binding according to claim 4, wherein said first locking lever has on a side thereof which faces said second locking lever and at a location between the pivot axis of said first locking lever and said shoulders thereon an extension which projects toward and is received in a locking recess provided in said second locking lever.

7. The binding according to claim 4, wherein said first locking lever is coupled to said second locking lever by plate which is pivotally coupled to each of said first nd second locking levers.

8. A safety ski binding, comprising a base member dapted to be supported on a ski, a sole holder supported on said base member for generally vertical ıovement between a downhill skiing position and a elease position located above said downhill skiing posi-.on, and releasable locking means for yieldably resist-ıg upward movement of said sole holder away from aid downhill skiing position, said releasable locking ıeans including a cam surface on said sole holder, a .rst lever which is supported on said base member for ivotal movement about a transversely extending first xis and which has at a first location spaced radially :om said first axis a nose which slidably engages said am surface, a second lever which is supported on said ase member on a side of said first lever remote from aid cam surface for pivotal movement about a second xis which extends substantially parallel to said first xis, first means cooperable with said first lever at a econd location between said nose and said first axis and vith said second lever at a first location spaced radially :om said second axis for operatively coupling said first nd second levers, resilient means cooperable with said econd lever at a second location spaced radially out-vardly from said first location thereon for yieldably rging said second lever toward said first lever so that aid first means causes said nose on said first lever to be rged against said cam surface, a manually operable elease member movably supported on said base mem-er, and second means cooperable with said release ıember and cooperable with said first lever at a third ocation spaced radially outwardly from said second location thereon for effecting, in response to manual movement of said release member, pivotal movement of said first lever in a direction causing said nose thereon to move away from said cam surface on said sole holder against the urging of said resilient means.

9. The binding according to claim 8, wherein said first means includes said first letter having at said second location thereon an extension which projects toward said second lever and which has a rounded end, and includes said second lever having at said first location thereon a recess which has a rounded surface therein and which receives said extension on said first lever, said rounded end of said extension slidably engaging said rounded surface in said recess.

10. The binding according to claim 8, wherein said first means include a link member which is pivotally coupled to said first lever at said second location thereon and is pivotally coupled to said second lever at said first location thereon.

11. The binding according to claim 8, wherein said release member is supported on said base member for pivotal movement about said first axis, and wherein said second means includes said first lever having an arcuate recess therein which is concentric with said first axis and includes said release member having an extension thereon which is slidably received in said arcuate recess in said first lever, manual pivoting of said release member causing said extension to engage an end of said arcuate recess in said first lever and to effect pivotal movement of said first lever with said release member in a direction causing said nose on said first lever to move away from said cam surface on said sole holder.

* * * * *